US005915702A

United States Patent [19]

Kirschling et al.

[11] Patent Number: 5,915,702

[45] **Date of Patent: *Jun. 29, 1999**

[54] IN-LINE SKATE AND WHEEL

[76] Inventors: Gerald C. Kirschling; Joseph B. Kirschling, both of 6073 Sharonwood La., Stevens Point, Wis. 54481

[ * ] Notice: This patent issued on a continued prosecution application filed under 37 CFR 1.53(d), and is subject to the twenty year patent term provisions of 35 U.S.C. 154(a)(2).

[21] Appl. No.: 08/657,673

[22] Filed: May 31, 1996

[51] Int. Cl.[6] ..... A63C 17/04

[52] U.S. Cl. ..... 280/11.22

[58] Field of Search ..... 280/842, 11.22, 280/11.23

[56] References Cited

U.S. PATENT DOCUMENTS

| | | | |
|---|---|---|---|
| 2,048,916 | 7/1936 | Bentzlin | 280/11.22 |
| 2,412,290 | 12/1946 | Rieske | 280/11.22 |
| 3,923,316 | 12/1975 | Birnbaum et al. | 280/11.22 |
| 5,271,633 | 12/1993 | Hill | 280/11.22 |
| 5,327,329 | 7/1994 | Stiles | 362/61 |
| 5,344,055 | 9/1994 | Edwards | 224/42.45 |
| 5,398,949 | 3/1995 | Tarng | 280/11.22 |
| 5,411,320 | 5/1995 | Alderman et al. . | |
| 5,456,478 | 10/1995 | Hsu et al. | 280/11.22 |

FOREIGN PATENT DOCUMENTS

| | | | |
|---|---|---|---|
| 4067 | 6/1894 | United Kingdom | 280/11.22 |
| 1120895 | 7/1968 | United Kingdom | 280/11.22 |

*Primary Examiner*—Thomas J. Brahan

*Attorney, Agent, or Firm*—Jansson, Shupe, Bridge & Munger, Ltd.

[57] ABSTRACT

An in-line skate and wheel particularly useful on a skating surface made of ice are provided. The in-line skate of the present invention includes a series of wheels aligned in a single row. The wheel of the present invention includes a circular body with a concave contact surface formed around the outer circumference of the circular body such that the concave contact surface and the wheel body form a pair of skating edges which engage the ice surface during skating. The wheels can be removed from the in-line roller skate and be replaced by a series of conventional rubber wheels for use on pavement.

9 Claims, 1 Drawing Sheet

IN-LINE SKATE AND WHEEL

FIELD OF THE INVENTION

The present invention generally relates to an in-line skate and, more particularly, to a removable metal wheel adapted for use with an in-line skate.

Background of the Invention

During their initial development, in-line skates were designed to simulate and re-create the look and feel of an ice hockey skate. The underlying goal behind in-line skates was to provide a means for hockey players to train during the off-season when the ice at outdoor rinks has melted. Before the advent of in-line roller skates, hockey players relied on methods of off-season training which did not efficiently target the specialized muscle groups important for skating. With the advent of in-line roller skates, hockey players could train in the off-season and isolate the muscles needed for skating.

Some of the earliest in-line skates removed the single metal skate blade and its mounting structure from an existing hockey boot and replaced each blade with a plastic bracket which received a series of rubber rollers mounted in a single line. By positioning the rollers in a single line, the modified ice hockey skate could be used during the summer months to train outdoors on paved bike paths, sidewalks, or roads. During the winter months, the wheel bracket and rubber rollers could be removed from the hockey boot and the metal blade be reattached for used on ice. During the past five to ten years, the popularity of in-line roller skating has greatly increased. In-line roller skates are currently constructed to include a specifically designed boot integrally molded to a wheel bracket which supports the series of rubber rollers in a single line. These in-line roller skates are designed specifically to be used with a series of rubber rollers on pavement. The rubber wheels designed for use on pavement have a convex outer surface which contacts the pavement during use. The convex outer surface allows the rubber wheel to maintain contact with the pavement when the user of the skate makes a turn. The rubber wheels would be ineffective if used on ice, since the convex outer surface is too soft and would not adequately grip the slick ice skating surface. If the skater wishes to skate on an ice covered surface either indoors or outdoors, he or she must purchase a pair of ice skates in addition to the relatively expensive in-line roller skates.

Currently skates exist in which the entire wheel bracket and rubber wheels can be removed and replaced by a conventional metal ice skating blade and mounting structure. However, interchanging these separate skating components usually involves special tools and a great deal of time.

Therefore, it can be appreciated that a removable wheel that allows a conventional in-line skate to be used on an ice surface without having to remove the entire wheel bracket from the in-line skate would be desirable.

It is an object of the present invention to provide a replaceable wheel which can be used with a standard in-line skate to allow the in-line skate to be used on an ice skating surface.

Another object of the present invention is to provide a metal wheel which has a concave contact surface that creates a pair of skating edges which securely grip the ice surface to make skating thereupon possible.

A still further object of the present invention is to provide an in-line skate having a series of metal wheels mounted in a single line within a wheel bracket below the skating boot.

SUMMARY OF THE INVENTION

In accordance with the present invention a wheel is provided for use with an in-line skate having a wheel bracket securely fixed to the sole of a skating boot. The wheel of the present invention includes a circular body having an axial center and an outer circumference. The body of the wheel has a pair of flat face surfaces which extend from the axial center and terminate at the outer circumference. A concave contact surface is positioned along the outer circumference between the pair of face surfaces.

The wheel of the present invention further includes a pair of skating edges which contact the skating surface. The pair of skating edges are created by the point of intersection between the concave contact surface and the pair of flat face surfaces of each wheel.

During usage of an in-line skate having a series of wheels in accordance with the present invention, the pair of skating edges of each wheel contact the skating surface to provide an effective method for engaging the skating surface. The wheels of the present invention are particularly useful when the in-line skate is used on an ice surface.

Each wheel of the present invention further includes a central mounting portion which extends outwardly from both of the face surfaces of the wheel. The central mounting portion is centered about the axial center of each wheel and is sized to receive a pair of rotatable bearings. The rotatable bearings are preferably press fit into the central mounting portion and contain a central aperture which allows a wheel axle to pass therethrough. The wheel axle is used to securely connect the wheel to the wheel bracket of the in-line skate. The bearing allows the metal wheel to freely rotate about the wheel axle within the wheel bracket of the in-line skate.

A series of removed areas are positioned between the central mounting portion and the outer circumference of the wheel body. The removed areas are each separated by a spoke, such that the combination of the spoke and the removed areas reduce the overall weight of the wheel, while still providing adequate strength to support the skater.

There are other features, objects and advantages of the invention which will be made apparent are used from the following description taken together with the drawings.

BRIEF DESCRIPTION OF THE PREFERRED EMBODIMENT

The drawings furnished herewith illustrate a preferred construction of the present invention in which the above advantages and feature are clearly disclosed as well as others which will be readily understood from the following description of the illustrated embodiment.

DETAILED DESCRIPTION OF THE PREFERRED EMBODIMENT

Figure 1:
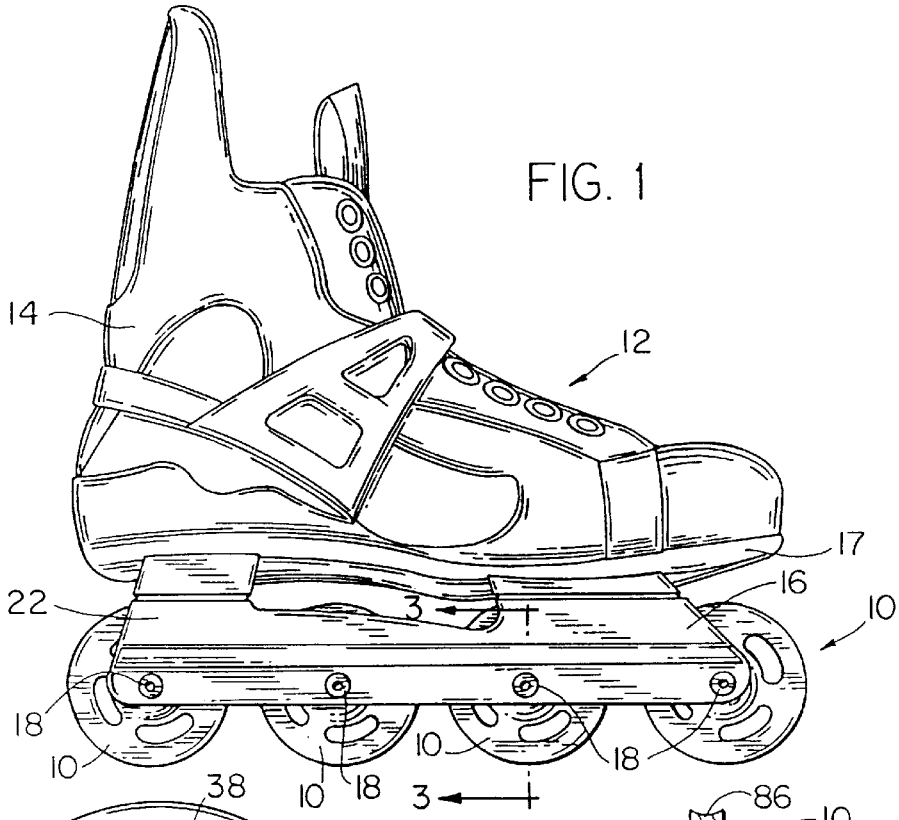
FIG. 1 is a side elevational view of an in-line skate incorporating four wheels in accordance with the present invention.

Referring to the drawings, a wheel in accordance with the present invention is generally designated by the reference numeral 10. Wheel 10 is adapted for mounting on a conventional in-line skate 12. The conventional in-line skate 12 typically consists of a boot 14, a wheel bracket 16 and a plurality of wheel axles 18. As can best be seen in FIG. 1, the wheel bracket 16 is integrally formed with the sole 17 of the boot 14. Wheel bracket 16 extends along a longitudinal axis such that the plurality of wheels 10 are rotatably mounted to thereto in a single line.

Figure 3:
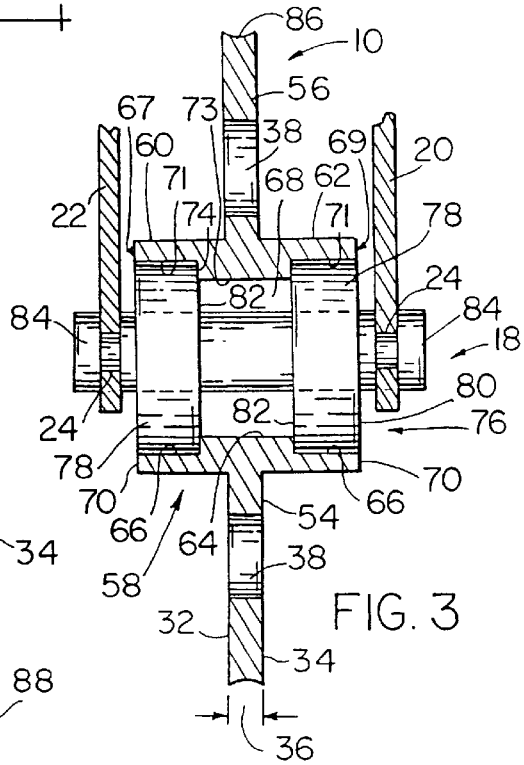
FIG. 3 is a sectional view taken along line 3—3 of FIG. 1.

As can best be seen in FIG. 3, the wheel bracket 16 inclines a pair of parallel side supports 20 and 22 which depend from sole 17. Each side support 20 and 22 contains a plurality of axle holes 24. The axle holes 24 contained on the side support 20 are in generally axial alignment with corresponding axle holes 24 contained in side support 22. The plurality of axially aligned axle holes 24 permit the mounting of a corresponding number of the wheels 10 between the side supports 20 and 22 through the use of the wheel axles 18, as will be described in detailed below.

Figure 2:
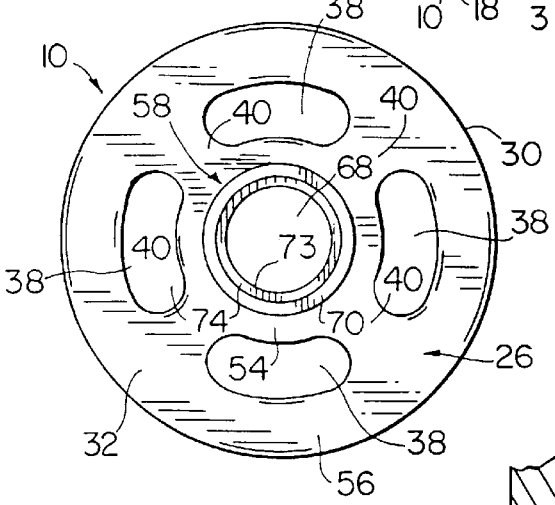
FIG. 2 is a side elevational view of a wheel in accordance with the present invention.

Referring now to FIG. 2, the wheel 10 of the invention is comprised of a metallic circular body 26. The circular body 26 is defined by an outer circumferential edge 30 and a pair of parallel, generally flat metallic face surfaces 32 and 34. The face surfaces 32 and 34 are spaced by the thickness 36 of the circular body 26, as shown by the arrows in FIG. 3.

A plurality of equally sized removed areas 38 are contained in the circular body 26. The removed areas 38 are removed portions of the circular body 26 which create an opening extending between the pair of face surfaces 32 and 34. The removed areas 38 reduce the overall weight of the circular body 26, which in turn reduces the overall weight of the in-line skate 12. Each of the removed areas 38 is separated from the adjacent removed area by a spoke 40. The spokes 40 maintain the strength of the circular body 26 such that the series of wheels 10 shown in FIG. 1 are adequate to support the weight of a user during operation of the in-line skate 12. The series of spokes 40 extend between a solid interior ring 54 and a solid exterior ring 56.

The wheel 10 further includes a metallic central mounting portion 58 that is centered about the axis of rotation of the wheel 10. The central mounting portion 58 is comprised of a pair of outer annular walls 60 and 62 which extend laterally from the corresponding face surfaces 32 and 34 in a direction parallel to the axis of rotation of wheel 10 and transverse to the longitudinal axis along which wheel bracket 16 extends. The central mounting portion 58 includes a generally cylindrical interior wall 64 which defines a central bearing receipt passageway 68 therethrough.

Referring now to FIG. 3, the internal wall 64 includes a pair of spaced, recessed inner wall portions 66. Each of the recessed portions 66 extend from a distinct end 67 and 69 of central mounting portion 58 toward the interior of passageway 68. A distinct face ring 70 is positioned over each distinct end 67 and 69 of central mounting portion 58.

Each recessed inner wall portions 66, of central mounting portion 58 defines a bearing receipt channel 71. Each of the recessed inner wall portions 66 are spaced by spaced surface 73 and intersect spaced surface 73 so as to form a bearing seat 74, FIG. 2.

Referring again to FIG. 3, a bearing 76 is inserted into each of the bearing receipt channel 71. Each bearing 76 is generally comprised of a cylindrical head 78 which contains an outer face 80 and an inner face 82. As can be seen in FIG. 3, the inner face 82 of each bearing 76 contacts its corresponding annular bearing seat 74 to securely position the bearing 76 within the central mounting portion 58. The width of each bearing receipt channel 71 corresponds to the width of the cylindrical head 78 of each bearing 76 such that the outer face 80 of each bearing head 78 lies flush with a corresponding end 67 and 69 of central mounting portion 58.

The pair of bearings 76 are common elements of an in-line skate and their internal workings are well known. The bearings 76 allow the wheel 10 to rotate when mounted within the wheel bracket 16, as shown in FIG. 1.

A wheel axle 18 passes through each pair of aligned axle holes 24 contained in the side supports 20 and 22 of the wheel brackets 16 as well as the bearings 76. An attachment head 84 is contained on each end of the wheel axle 18 to securely position the wheel axle 18 between the pair of side supports 20 and 22. The wheel axle 18 securely supports the wheel 10 within the wheel brackets 16, while allowing the wheel 10 to rotate about the bearings 76, as is well known in the in-line skate art.

In the preferred embodiment of the invention, the circular body 26 is formed from a metallic material, such as stainless steel or any equivalent thereto.

Figure 4:
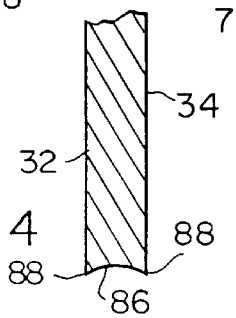
FIG. 4 is an enlarged sectional view showing a portion of the wheel of FIG. 3.

Positioned between the pair of face surfaces 32 and 34 around the outer circumferential edge 30 of the circular wheel body 26 is an outer contact surface 86. As can best be seen in FIG. 4, in the preferred embodiment of the invention, the outer contact surface 86 is concave. The concave outer contact surface 86 intersects each of the planar face surfaces 32 and 34 and creates a pair of skating edges 88.

Since the circular wheel body 26 is constructed of a metal material in the preferred embodiment, each of the skating edges 88 are relatively sharp and resist wear when used. An in-line skate which contains a plurality of the wheels 10 as previously described, as shown in FIG. 1, is particularly effective when used on an ice skating surface. When used as such, the pair of skating edges 88 of each wheel 10 contact the ice surface. When the user of the in-line roller skate 10 makes a turn, one of the skating edges 88 remains in contact with the ice surface, such that the user can maintain a cutting edge with the ice surface and maintain his or her balance.

It is within the scope of the present invention that a series of conventional rubber in-line skate wheels (not shown) may be substituted for the wheels 10 of the present invention when the in-line skate 12 is used indoors or outdoors on a paved surface. When the user wishes to use the in-line skate 12 on an ice surface, the user can remove the conventional rubber wheels and replace them with the metal wheels 10 as described previously. The metal wheels 10 contain a pair of durable skating edges 88 which are useful in gripping and contacting the ice skating surface, unlike the normally convex contact surface contained on a conventional rubber in-line skate wheel. In this manner, the owner of the in-line skate 12 can quickly and easily replace the series of wheels depending upon which type of surface he or she wishes to skate upon.

The present invention and its advantages will be understood from the foregoing description and it will be apparent that various changes may be made thereto without departing from the spirit and the scope of the invention, as set forth in the following claims or sacrificing all of its material advantages, the form heretobefore described being merely a preferred or exemplary embodiment thereof.

I claim:

1. An in-line roller skate for use on an ice skating surface, said in-line roller skate comprising:

a skating boot having an upper portion and a sole;

an elongated wheel bracket extending along a longitudinal axis and fixed to the sole of said skating boot; and a plurality of spaced wheels rotatable mounted to said wheel bracket, each of said wheels rotating about a corresponding axis transverse to the longitudinal axis, each wheel comprising:

a single metallic circular body having an axial center, the metallic circular body defined by first and second generally flat planer, face surfaces extending radially from said axial center and terminating at an outer circumference;

first and second bearing mounting elements integral with and extending laterally from a corresponding face surface, each bearing mounting member defining a generally cylindrical outer surface and terminating at a generally planer, bearing surface spaced from the metallic body and having a bearing receipt cavity extending therein, wherein each face surface of the circular body and a plane extending through a corresponding bearing surface define a corresponding void therebetween;

first and second rotatable bearings, each rotatable bearing mounted in a corresponding bearing receipt cavity;

a single concave outer surface along the outer circumference of the circular body, said concave outer surface being positioned between said first and second face surfaces along the outer circumference of the wheel; and first and second skating edges, each skating edge formed at a point of intersection between said concave outer surface and a corresponding face surface, the skating edges engaging the ice skating surface during use of the skate.

2. The in-line skate of claim 1, wherein each of said plurality of wheels includes a plurality of voids therein, each of said voids being formed in the circular body.

3. The in-line skate of claim 1, wherein each of the rotatable bearings is frictionally retained within the corresponding bearing receipt cavity of the bearing mounting elements of each wheel.

4. The in-line skate of claim 1, wherein said plurality of wheels and said plurality of wheel axles are demountably attached to said wheel bracket.

5. The in-line skate of claim 1, wherein each of said plurality of wheels are constructed from stainless steel.

6. A wheel for use with an in-line skate on an ice skating surface, the skate having a wheel bracket securely fixed to the sole of a skating boot for rotatably supporting the wheel, the wheel comprising:

a central mounting portion having an axial center, the center mounting portion having a predetermined width and diameter and terminating at first and second generally planer end surfaces;

a single circular body integral with the central mounting portion, the circular body defined by a first, generally planer face surface extending radially outward from the central mounting portion and a parallel, generally planer second face surface extending radially outward from the central mounting portion such that the circular body has a width therebetween, the width of the circular body between the first face surface and the second face surface being substantially less than the width of the central mounting portion, wherein each face surface of the circular body and a plane extending through a corresponding bearing surface define a corresponding void therebetween;

a single concave outer surface formed along the outer circumference of the circular body between the first face surface and the second face surface; and a pair of skating edges, each of the skating edges being formed at a point of intersection between the concave outer surface and the first and second face surfaces, the skating edges engaging the ice skating surface during use of the skate.

7. The wheel of claim 6 wherein the central mounting portion and the circular body are formed from a metallic material.

8. The wheel of claim 6 wherein the central mounting portion includes a pair of bearing receipt cavities formed therein.

9. A wheel for an in-line ice skate, comprising:

a generally cylindrical central hub extending along a longitudinal axis and defining an external cylindrical surface, the central hub terminating at first and second opposite, generally planer end surfaces, each end surface including a generally cylindrical bearing receipt cavity of predetermined diameter extending toward the interior of the central hub, the central hub further including an axle passageway extending between and communicating with each bearing receipt cavity, the axle passageway having a diameter less than the diameter of each bearing receipt cavity; and a single circular blade integrally formed with and extending radially from the external cylindrical surface of the central hub, the blade defined by first and second, generally planer side surfaces, each side surface longitudinally displaced from a corresponding end surface of the central hub and intersecting the external cylindrical surface of the central hub, such that each side surface of the blade and a plane extending through a corresponding end surface of the central hub define a void therebetween the blade further defined by a single, concave outer surface having a first end intersecting one of the side surfaces to form a first contact edge, and a second end intersecting the second of the side surfaces to form a second contact edge.

* * * * *